United States Patent [19]

Suto et al.

[11] Patent Number: 4,801,974

[45] Date of Patent: Jan. 31, 1989

[54] SAFETY DEVICE FOR FIXING HEATER

[75] Inventors: Toshihiko Suto; Katsuo Suzuki, both of Saitama, Japan

[73] Assignee: Fuji Xerox Co., Ltd., Tokyo, Japan

[21] Appl. No.: 143,386

[22] Filed: Jan. 13, 1988

[30] Foreign Application Priority Data

Jan. 23, 1987 [JP] Japan ..... 62-12238

[51] Int. Cl.[4] ..... G03G 15/20

[52] U.S. Cl. ..... 355/14 FU; 355/30; 219/216; 219/510

[58] Field of Search ..... 355/3 FU, 14 FU, 30; 219/216, 508–510; 432/59–60

[56] References Cited

U.S. PATENT DOCUMENTS 4,541,708 9/1985 Shigenobu ..... 355/14 FU X

FOREIGN PATENT DOCUMENTS 59-152475 8/1984 Japan ..... 355/14 FU

*Primary Examiner*—Arthur T. Grimley
*Assistant Examiner*—J. Pendegrass
*Attorney, Agent, or Firm*—Finnegan, Henderson, Farabow, Garrett, & Dunner

[57] ABSTRACT

Method and apparatus are provided for minimizing delay in the operation of a safety device in a device for thermally fixing an image to a paper medium. A safety device, such as a thermostat, is set to deactivate a heater unit if the temperature of the heater unit exceeds a first temperature value. If the temperature of the thermal unit exceeds a second temperature value lower than the first temperature value, a heat exhausting device, such as a fan, is turned off. Shutting off the heat exhausting device stops cooling of the heater, thus decreasing the time elapsed before the safety device can detect the first temperature value.

10 Claims, 4 Drawing Sheets

SAFETY DEVICE FOR FIXING HEATER

BACKGROUND OF THE INVENTION

Field of the Invention

The present invention relates to a safety device used in an apparatus, such as a copying machine, provided with an electric heating device, and particularly relates to a safety device which can rapidly cope with an occurrence of abnormality in an electric heating device.

Description of the Prior Art

In copying machines and some kinds of printers, such as a laser printer and the like, an electrostatic latent image is formed on a photosensitive drum, the latent image is developed with toner, and the toner image is transferred onto paper. Thereafter the transferred toner image is fixed. Ordinarily, the fixing of the toner image is carried out by using heat energy. There are various methods of fixing the toner image. One common method used is a fixing device employing a heat roll because of (i) its low deterioration of picture quality and (ii) its high safeness.

FIG. 6 shows an example of the circuit arrangement of a conventionally used fixing device. In the circuit, a solid state relay (SSR) 2, a heater 3, and a thermostat 4 are connected in series to a 100 V commercial power source 1A. Here, the heater 3 is used to heat a heat roll 5 for fixing a toner image. Unlike a mechanical relay, the solid state relay 2 performs a relay function with its solid-state characteristic.

A thermistor module 6 provided with a thermistor as a temperature detecting element lightly touches a surface of the heat roll 5. Surface temperature information 8 of the heat roll 5, produced by the thermistor module 6, is fed to a temperature control portion 9. The temperature control portion 9 consists of a data input buffer amplifier 9A, a data processing portion 9B for processing a signal produced by the data input buffer amplifier 9A, and a data output buffer amplifier 9C for outputting the signal processed by the data processing portion 9B.

The data processing portion 9B is constituted by an A/C converter for analog-to-digital converting of the analog surface temperature information 8, a CPU (central processing unit), a clock generating circuit, and so on. The data processing portion 9B produces a temperature control signal in response to the surface temperature information 8. A temperature control signal 11 produced from the data output buffer amplifier 9C is applied to a control terminal of the solid state relay 2. The current conduction of the heater 3 is controlled by the solid state relay 2.

The thermostat 4 is arranged to open its contact upon detection of a state of overheat of the heat roll 5. In case of such an abnormal state, a loop passing through the commercial power source 1A is opened so as to prevent a current to flow in the heater 3. That is, when a fault has occurring in the temperature control portion 9 allows a current to continuously flow in the heater 3, the thermostat 4 is caused to operate to secure safety of the apparatus.

However, because the fixing device is provided with a heat source, there is a possibility that the temperature in an apparatus such as a copying machine or the like will be raised to a value unsuitable to a photosensitive drum and other parts. Particularly, since a photo semiconductor is used as a photosensitive drum in certain kinds of printers, a photosensitive characteristic may change considerably so as to make it impossible to form a good picture when the temperature of the machine falls out of an allowable temperature range. Therefore, a heat exhausting device (fan) 13 is provided in the machine. A heat exhausting device controlling circuit 14 controls the current fed from a 100 V commercial power source 1B to the heat exhausting device 13, so as to make the heat exhausting device 13 to remove heat, as required, to keep the temperature inside the machine at a value within a substantially fixed temperature range.

As described above, a safety device using the thermostat 4 is used in the fixing device. If a short circuit occurs in an element, such as the solid state relay 2 for feeding power to the heater 3, causing power to be continuously fed to the heater 3, then the thermostat 4 is actuated to operate to stop feeding the power to the heater 3.

When the control for feeding power to the heat source becomes impossible to be correctly carried out in various of situations as described above, measures have been taken to ensure the safety of the apparatus under the thought of "fail safe".

In the conventional safety device shown in FIG. 6, the operational characteristics of the thermostat 4 are much influenced by the flow of air. Thus, the detection of an abnormal situation is considerably delayed when the heat exhausting device 13 is operating. If the detection of the abnormal situation is delayed, a risk arises that deformation in the surface of the heat roll acting as a thermal fixer, or deformation in a peeling pawl always touching the surface of the heat roll so as to peel paper, will occur.

An object of the present invention is to provide a safety device which can rapidly take safety measures to cope with abnormality in an apparatus provided with a thermal fixer as a heat source and a heat exhausting device for externally exhausting heat.

SUMMARY OF THE INVENTION

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention provides: a heater mounted in the housing adjacent to the heat roller operative to heat the heat roller. There is also provided a power source, first temperature detecting means for deactivating the heater in response to a first temperature value indicative of a first abnormal condition in the heat roller, a heat exhausting device in the housing operating when activated to maintain the interior of the housing, including the heat roller, below a second temperature value lower than the first temperature value at times when the heat roller is in a normal condition. The heat exhausting device delays the detection of the first temperature value under abnormal conditions. A switch means includes a switch operable to an open or closed position. A second temperature detecting means detects a third temperature value in the housing lower than the first temperature value and higher than the second temperature value, the third temperature value being indicative of a second abnormal condition. A first circuit means includes the power source, the heater, and the first temperature detecting means, for deactivating the heater upon detecting a temperature value higher than the first temperature value. Second circuit means including the power source, the heat exhausting device, and the switch means responsive to the second temperature detecting means, activates the heat exhausting device via the switch means in the closed position at times when the heat roller is in the normal condition and deactivates the heat exhausting device via the switch means in the open position at times when the heat roller is in the second abnormal condition.

That is, according to the present invention, when the temperature becomes abnormal, the heat exhausting device is temporarily stopped to stop the flow of air, so that operation of the thermostat or the like is not delayed. The heat exhausting device may be restarted after the operation of the thermostat or the like.

According to another aspect, a safety device of the present invention for an apparatus having a means for thermally fixing images on a paper and a means for exhausting heat outside of the apparatus, comprises: means for detecting temperature of the thermal fixing means; means for judging whether the temperature detected by the detecting means is within a normal temperature control region; and means for controlling drive of the heat exhausting device so as to stop operation of the heat exhausting device when the judging means judges that the detected temeprature is out of the normal temperature region.

The accompanying drawings, which are incorporated in and constitute a part of this specification, illustrate several embodiments of the invention and together with the description, serve to explain the principles of the invention.

BRIEF DESCRIPTION OF THE DRAWING

FIG. 1 is a circuit diagram showing a main portion of a printer in which a safety device is provided.

FIG. 2 is a schematic constituent view of the printer of a preferred embodiment.

FIG. 3 is a temperature control characteristic diagram showing the state in which the surface temperature of a heat roll is controlled.

FIG. 4 is a flow chart showing the state of the temperature control.

FIG. 5 is a circuit diagram showing a second preferred embodiment of the printer in which the safety device is provided

DESCRIPTION OF THE PREFERRED EMBODIMENT

Reference will now be made in detail to the present preferred embodiments of the invention, examples of which are illustrated in the accompanying drawings. Wherever possible, the same reference numbers will be used throughout the drawings to refer to the same or like parts.

Figure 2:
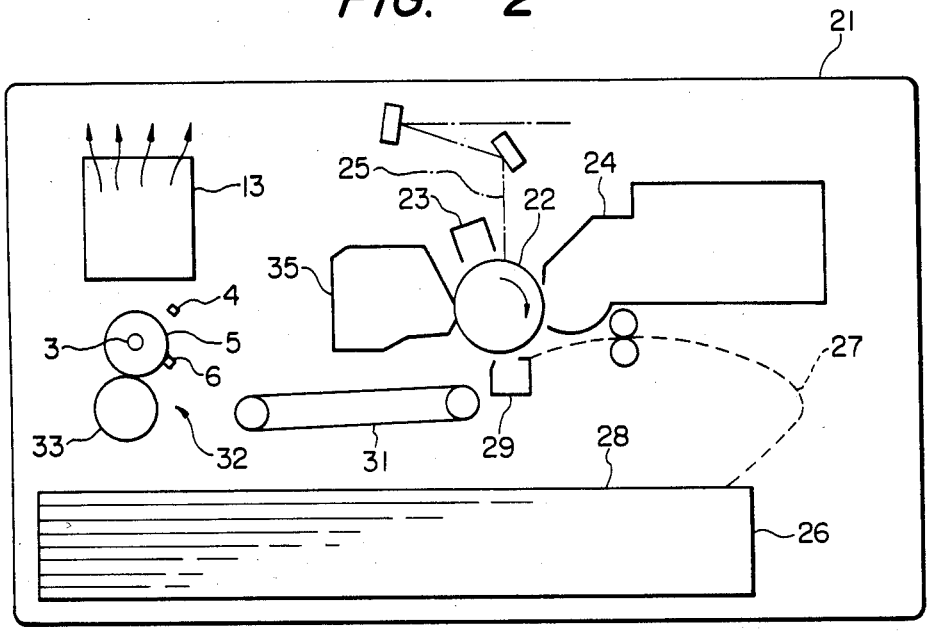

FIG. 2 shows a main portion of a printer to which an embodiment of the safety device according to the present invention is applied. The printer 21 is provided with a photosensitive drum 22. An electrically charging corotron 23 is provided above the photosensitive drum 22 and arranged to apply charges onto a surface of the drum which is arranged to rotate in the direction indicated by an arrow in the drawing. The charged surface of the drum is irradiated with a laser beam 25 so as to form an electrostatic latent image and then is developed by a developing device 24 used both as a toner storing vessel and a developer. A toner image formed through the development by the developing device 24 is transferred onto recording paper 28 conveyed from a supply tray 26 along a conveying path 27. The transfer of the toner image is carried out by the operation of a transfer corotron 29 acting as a transfer device. The recording paper onto which the toner image has been transferred is conveyed by a conveying belt 31 to a fixing device 32 so as to be fixed. The fixing device 32 is constituted by a heat roll 5 incorporating a heater 3 and a pressure roll 33 for pressing the recording paper against the heat roll 5. A heat exhausting device 13 is provided above the heat roll 5 so as to discharge air in the printer 21 to the outside of the printer when necessary.

Figure 6:
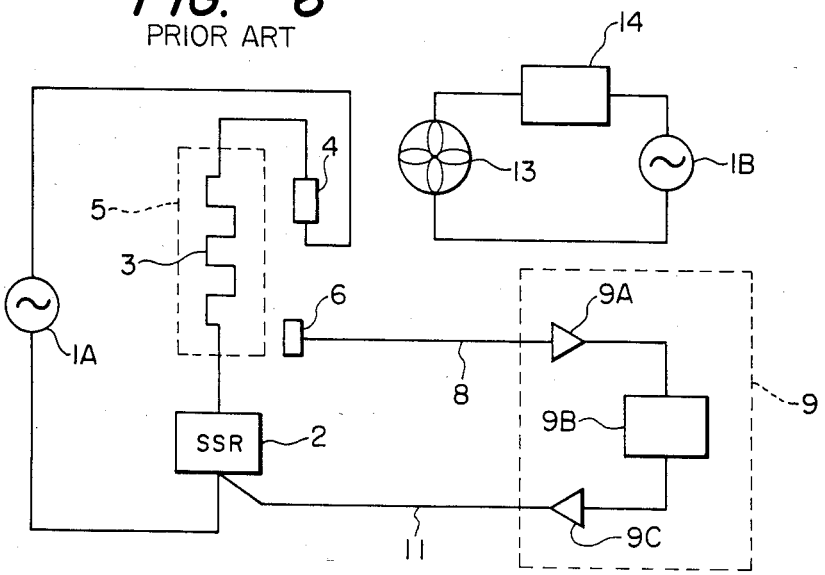
FIG. 6 PRIOR ART
FIG. 6 is a circuit diagram showing an example of the circuit arrangement in the conventional fixing apparatus provided with a safety device.

After transferring the toner image onto the recording paper, the photosensitive drum 22 is cleaned by a cleaning device 35, and then electrically charged again by the charge corotron 23 so as to prepare for the succeeding exposure operation. A thermistor module 6 is disposed to lightly touch a surface of the heat roll 5 as described with respect to FIG. 6, and a thermostat 4 is provided at a position separated a little from the heat roll 5.

Figure 1:
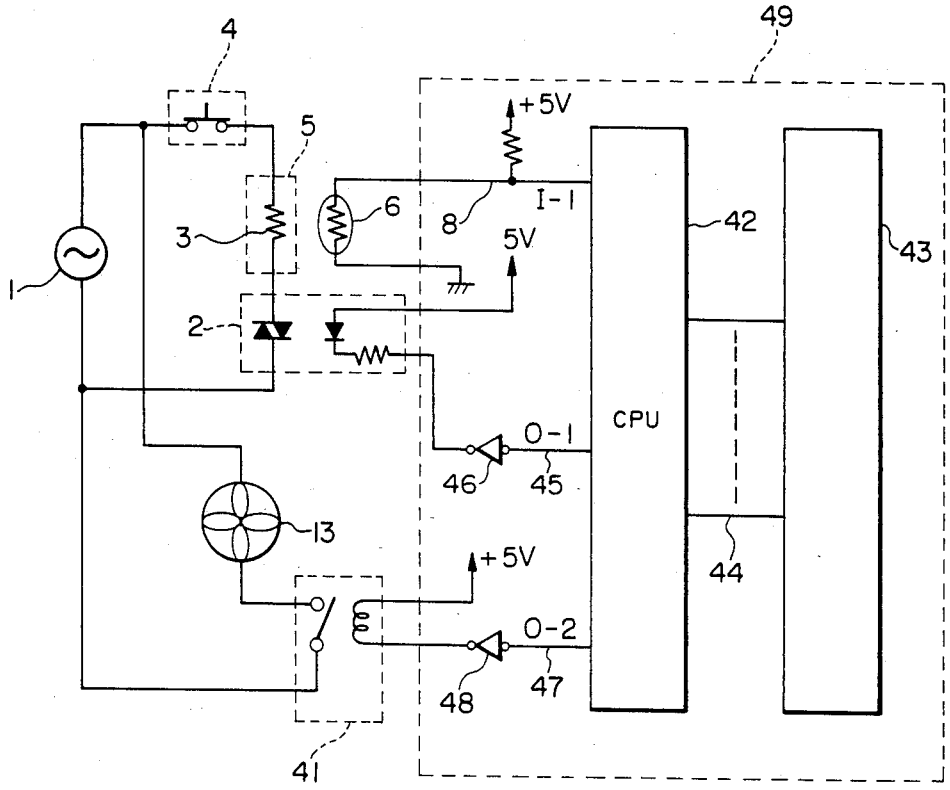
FIGS. 1 through 4 show a first embodiment of the present invention.

FIG. 1 shows a circuit arrangement of the main portion of such a printer. In the printer, a 100 V commercial power source 1 is connected to a first series circuit constituted by the heater 3, the thermostat 4, and a solid state relay 2. A second series circuit is constituted by the heat exhausting device 13 and a relay 41 for driving the heat exhausting device. The thermistor module 6 having a thermistor disposed on a surface thereof as a temperature detecting element is provided in the vicinity of the heater 3 so as to touch the surface of the heat roll 5. Surface temperature information 8 obtained from the thermistor module 6 is applied to an analog input port I-1 of a central processor unit (CPU) 42. The surface temperature information 8 in the form of an analog signal applied to the analog input port I-1 is analog-to-ditigal converted by an A/D converter provided in the CPU 42 and subjected to signal processing.

The CPU 42 is connected to a peripheral circuit 43 such as a clock generator, input and output ports, and the like, through a bus 44 and arranged to output a temperature control signal 45 from a first output port O-1 as a result of processing of the surface temperature information 8 so as to control the temperature of the heater 3 to a fixed value. The temperature control signal 45 is supplied to a driver 46 as a control input for performing the on/off control of the solid state relay 2.

The CPU 42 further outputs an emergency control signal 47 from a second output port O-2 as a result of other processing of the surface temperature information 8. The emergency control signal 47 is produced in the state where the surface temperature of the heater 3 is abnormally raised as described later. The emergency control signal 47 is supplied to a driver 48 as a control input for turning on/off the operation of the relay 41 for driving the heat exhausting device.

In the circuit shown in FIG. 1, the CPU 42, the peripheral circuit 43, and the two drivers 46 and 48 preferably are provided on one and the same substrate and act as a control device 49 mainly for controlling a fixer.

Figure 3:
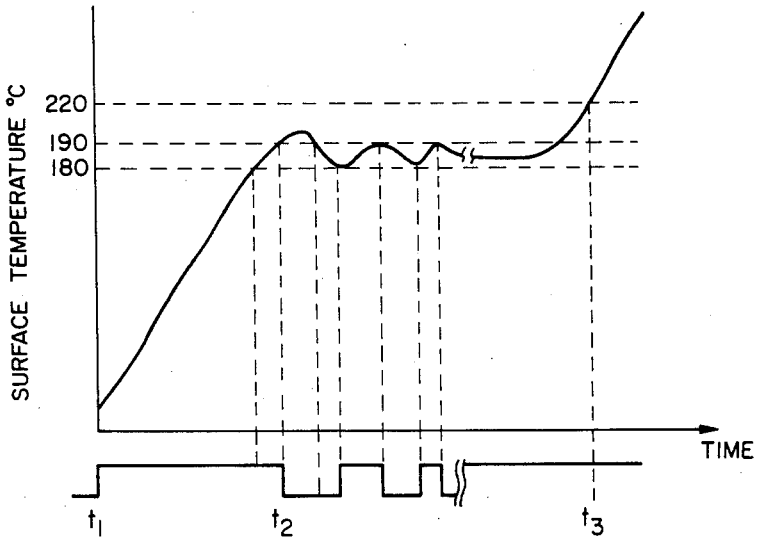

FIG. 3 shows the state in which the surface temperature of the heat roll in the printer is controlled. When a power source for the printer is turned on at a point in time t1, the temperature control signal 45 is output from the first output port O-1. A current is caused to flow in the heater 3 continuously until a point in time t2 at which the temperature of the heat roll 5 becomes 190° C. Then, the solid state relay 2 is turned on, causing a current to flow from the commercial power source 1 to the heater 3 in every period from a point in time at which the surface temperature of the heat roll 5 has been lowered to 180° C. to another point in time at which the surface temperature of the heat roll 5 has been raised to 190° C. Thus, in the embodiment, the surface temperature of the heat roll 5 is maintained in a temperature range from about 180° C. to about 190° C.

When any abnormality occurs in the control device 49, causing current to flow continuously in the heater 3, the surface temperature of the heat roll 5 will reach 220° C. at a point in time t3 in FIG. 3. At that point in time, the CPU 42 produces the emergency control signal 47 so that the relay 41 for driving the heat exhausting device stops causing a current to flow in the heat exhausting device 13. The thermostat 4 disposed so as to be separated slightly from the surface of the heat roll 5 can then monitor the temperature of the heat roll 5 without being influenced by the heat exhausting device 13. That is, when the airflow is stopped, the thermostat 4 more rapidly detects the temperature of the heat roll 5 and opens its contact at a point in time before occurrence of a fault in the heat roll 5. Accordingly, the current is stopped from flowing from the commercial power source 1 to the heater 3.

Figure 4:
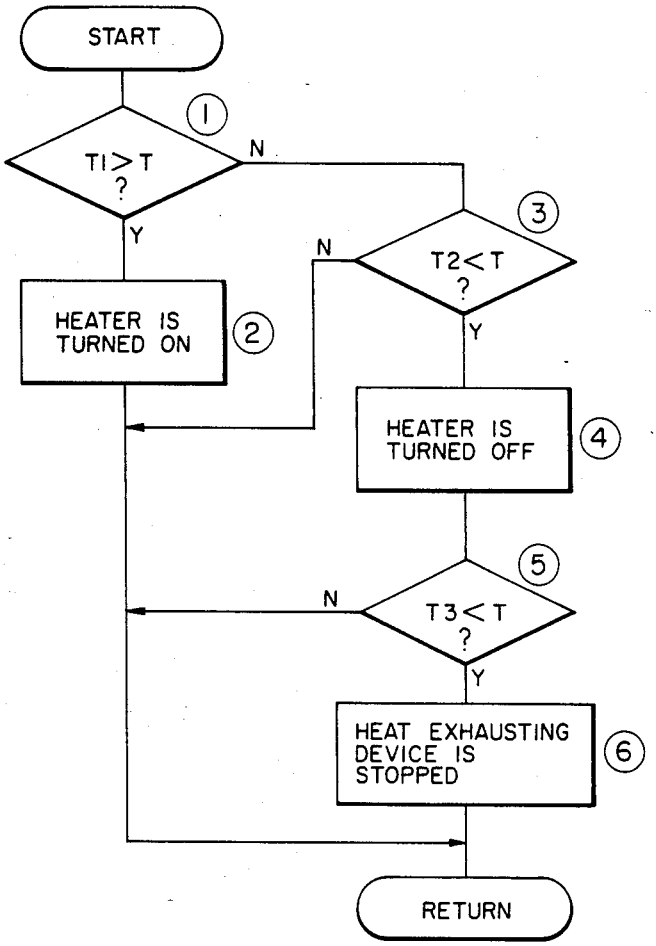

FIG. 4 shows the operation of the CPU for performing the control described above. The CPU 42 performs the following control in accordance with a procedure for temperature control written in a not-shown memory.

First, the CPU 42 determines whether the temperature T is lower than a first temperature value T1 for the fixing operation (180° C. in the present embodiment) on the basis of the surface temperature information 8 (step 1). If the temperature T is lower than the first temperature value T1, the heater is turned on (Step 2). In any other cases, determination is made as to whether the temperature T is higher than a second temperature value T2 for fixing operation (190° C. in the embodiment) (step 3). If the temperature T is higher than the second temperature value, the heater 3 is turned off (step 4). In the case where the temperature T is not higher than 190° C., the current is caused to flow continuously.

On the other hand, if the temperature T is higher than the second temperature T2 in the step 3, there is a possibility that the temperature T has reached an abnormal temperature value. In that case, it is determined whether the temperature T is higher than a temperature value T3 (220° C. in the present embodiment) which is an abnormal temperature value (step 5). If the temperature T is higher than the abnormal temperature value, the heat exhausting device 13 is stopped (step 6). At the same time, the emergency control signal 47 is produced.

In the present embodiment, at a point in time at which the surface temperature of the heat roll 5 was raised to 240° C. by stopping the heat exhausting device 13, the thermostat 4 was actuated to operate so that a current flow was stopped in the heater 3. In the same printer, when the heat exhausting device 13 was operated, the thermostat 4 was actuated to operate at a point in time at which the surface temperature of the heat roll 5 was raised to 280° C. That is, the operational point of the thermostat 4 was lowered by about 40° C. by stopping the heat exhausting device 13 even momentarily upon occurrence of abnormality, so that it became possible that a secondary obstacle applied to a fixing device was effectively prevented.

Figure 5:
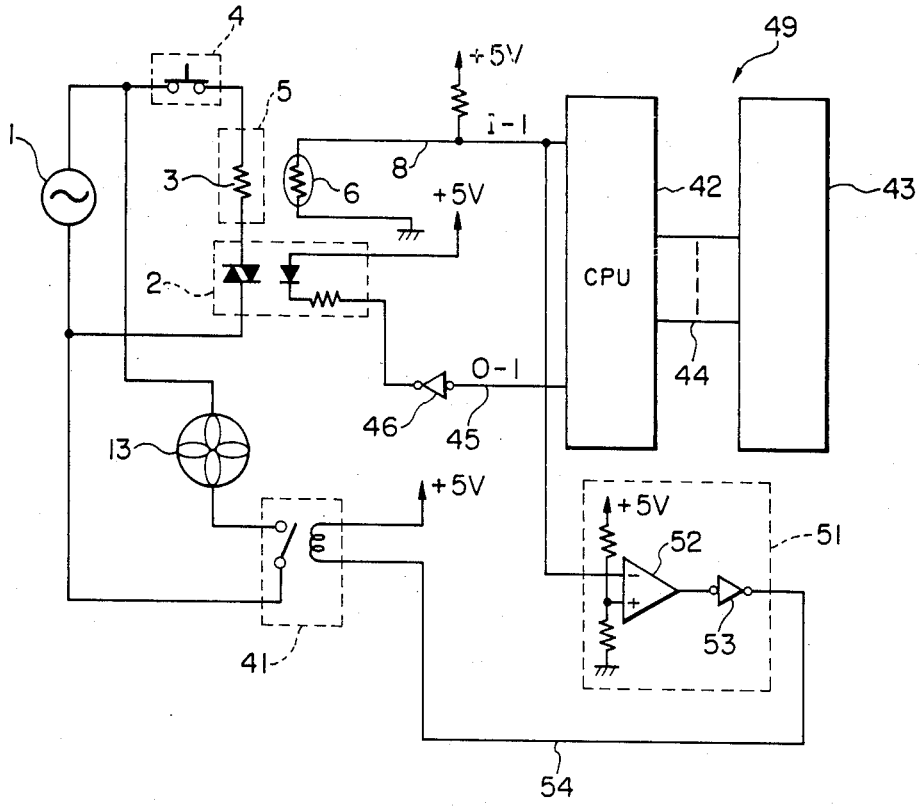
FIG. 5 shows a second embodiment of the present invention.

FIG. 5 shows a second preferred embodiment of the present invention. In FIG. 5, the same parts as those in FIG. 1 are correspondingly referenced, and the description of them will be suitably omitted.

In the first preferred embodiment described above, the CPU 42 (see FIG. 1) was arranged to detect abnormal heat. Accordingly, if the CPU 42 itself is out of order, measures cannot be taken to cope with the abnormal heating. In the modification shown in FIG. 5, the surface temperature information 8 of the heat roll 5 produced from the thermistor module 6 is supplied not only to the CPU 42 but to a control portion 51 separately provided for controlling the heat exhausting device. The heat exhausting device control portion 51 is provided with a comparator 52 for comparing the surface temperature information 8 with a reference voltage. If an abnormal temperature occurs, an emergency control signal 54 is produced from a driver 53. The emergency control signal 54 is used as a control input for making on/off the operation of the relay 41 for driving the heat exhausting device.

Thus, in the modification, a circuit for detecting the abnormal heating is provided separately from ordinary temperature control means, so that the heat exhausting device 13 is stopped even if the CPU 42 is out of order. Accordingly, the secondary damage of the apparatus can be reduced.

In the embodiment and the modification described above, a thermostat is used as a safety device, but a thermo fuse or any other similar element or circuit may be used. Although a CPU having an analog input port is used as a control device in both described embodiments, an ordinary digital processing CPU may be used or a circuit having the same function may be constituted by a comparator.

Thus, according to the present invention, the heat exhausting device is arranged to stop operating when the thermal fixer exceeds a normal temperature control range. Not only is the operation of the safety device such as the thermostat or the like made certain, but the reliability of the safety device itself can be improved.

Other embodiments of the invention will be apparent to those skilled in the art from consideration of the specification and practice of the invention as disclosed herein. It is intended that the specification and examples be considered as exemplary only, with the true scope and spirit of the invention being indicated by the following claims.

What is claimed is:

1. A heating system for thermally fixing an image to a paper medium having a heat roller mounted in a housing, said system comprising:

a heater mounted in the housing adjacent to said heat roller operative to heat said heat roller;

a power source;

first temperature detecting means for deactivating said heater in response to a first temperature value indicative of a first abnormal condition in the heat roller;

a heat exhausting device in the housing operating when activated to maintain the interior of the housing, including said heat roller, lower than a second temperature value lower than said first temperature value at times when said heat roller is in a normal condition, said heat exhausting device at least delaying the detection of said first temperature value under abnormal conditions;

a switch means including a switch operable to an open or closed position;

second temperature detecting means for detecting a third temperature value in said housing lower than said first temperature value and higher than said second temperature value, said third temperature value indicative of a second abnormal condition;

first circuit means including said power source, said heater, and said first temperature detecting means for deactivating said heater upon detecting a temperature value higher than said first temperature value; and second circuit means including said power source, said heat exhausting device, and said switch means responsive to said second temperature detecting means, for activating said heat exhausting device via said switch means in said closed position at times when said heat roller is in said normal condition and deactivating said heat exhausting device via said switch means in said open position at times when said heat roller is in said second abnormal condition.

2. The system of claim 1 wherein said second temperature detecting means further comprises:

third temperature detecting means for activating said heat roller in response to a fourth temperature value lower than said second temperature value, indicative of a condition where said system will not operate optimally until said heat roller is heated and deactivating said heat roller in response to a fifth temperature value lower than said third temperature value and higher than said fourth temperature value indicative of a condition where said system will not operate optimally until heat is removed from said heat roller.

3. The system of claim 1 wherein said first temperature detecting means comprises:

a thermostat capable of halting current flow between said power source and said heat roller.

4. The system of claim 1 wherein said second temperature detecting means comprises:

a thermistor disposed adjacent to said heat roller; and a central processor connected to said thermistor.

5. The system of claim 1 wherein said second temperature detecting means further comprises:

fourth temperature detecting means for detecting a sixth temperature value in said heat roller lower than said third temperature value, said sixth temperature value indicative of the end of said abnormal conditions and the beginning of said normal condition; and restart means responsive to said fourth temperature detecting means for causing said heat exhausting device to operate.

6. A heating system for thermally fixing an image to a paper medium having a heat roller mounted in a housing, said system comprising:

a heater mounted in the housing adjacent to said heat roller operative to heat said heat roller;

a power source;

first temperature detecting means for deactivating said heater in response to a first temperature value indicative of a first abnormal condition in the heat roller;

a heat exhausting device in the housing operating when activated to maintain the interior of the housing, including the heat roller lower than a second temperature value lower than said first temperature value at times when said heat roller is in a normal condition, said heat exhausting device at least delaying the detection of said first temperature value under abnormal conditions;

second temperature detecting means for detecting a third temperature value in said housing lower than said first temperature value and higher than said second temperature value, said third temperature value indicative of a second abnormal condition;

first switch means including a switch operable to an open or closed position;

third temperature detecting means for maintaining the temperature of said heat roller inside a temperature range having a low range value lower than said second temperature value indicative of a condition where said system will not operate optimally until said heat roller is heated and a high range value lower than said third temperature value and higher than said low range value indicative of a condition where said system will not operate optimally until heat is removed from said heat roller;

second switch means including a switch operable to an open or closed position;

first circuit means including said power source, said heater, said first temperature detecting means for deactivating said heater upon detecting a temperature value higher than said first temperature value, and said second switch means responsive to said third temperature detecting means for activating said heater via said second switch means in said closed position at times when said system will not operate optimally until said heat roller is heated and deactivating said heater via said second switch means in said open position at times when said system will not operate optimaly until heat is removed from said heat roller; and second circuit means including said power source, said heat exhausting device, and said first switch means responsive to said second temperature detecting means, for activating said heat exhausting device via said first switch means in said closed position at times when said heat roller is in said normal condition and deactivating said heat exhausting device via said switch means in said open position at times when heat roller is in said second abnormal condition.

7. A method for minimizing delay in detecting an abnormal condition in a device for fixing an image to a paper medium having a heater, a heat roller heated by said heater, a heat exhausting device for cooling said fixing device and a safety device for detecting an abnormal condition, a normal condition occurring when said temperature of said heater is within a temperature range having a low range value and a high range value, and said abnormal condition occurring when said temperature of said heater exceeds an abnormal temperature value higher than said high range value, said method comprising:

measuring the temperature of said heat roller;

comparing said measured temperature to said low range value;

applying heat to said heat roller when said measured temperature is lower than said low range value;

comparing said measured temperature to said high range value;

removing heat from said heat roller when said measured temperature is higher than said high range value;

comparing said measured temperature to a predetermined danger value higher than said high range value and lower than said abnormal temperature value;

eliminating the cooling from said fixing device when said measured temperature is higher than said predetermined danger value, causing said temperature of said heat roller to increase at a faster rate than a rate at which said temperature increases when said fixing device is being cooled; and stopping the heating of said heat roller when the safety device detects said abnormal temperature value in said heat roller.

8. A safety device for an apparatus having a means for thermally fixing images on a paper and a means for exhausting heat outside of said apparatus, comprising:

means for detecting temperature of said thermal fixing means;

means for judging whether the temperature detected by said detecting means is within a normal temperature control region; and means for controlling drive of said heat exhausting device so as to stop operation of said heat exhausting device when said judging means judges that the detected temperature is out of the normal temperature region.

9. A safety device according to claim 8, wherein said temperature detecting means comprises thermostat connected in series to a power source of said thermal fixing means, said thermostat operating in a state where said thermal fixing means is overheated.

10. A safety device according to claim 9, wherein said heat exhausting device controlling means comprises means for restarting drive of said heat exhausting device when said thermostat operates.

* * * * *